US011053639B2

(12) United States Patent
Short

(10) Patent No.: US 11,053,639 B2
(45) Date of Patent: Jul. 6, 2021

(54) REFINING MEMBER AND HUB WITH SPLINES WITH A WEAR INDICATOR

(71) Applicant: Robert Short, Antrim, NH (US)

(72) Inventor: Robert Short, Antrim, NH (US)

(73) Assignee: VALMET TECHNOLOGIES OY, Espoo (FI)

( * ) Notice: Subject to any disclaimer, the term of this patent is extended or adjusted under 35 U.S.C. 154(b) by 193 days.

(21) Appl. No.: 16/434,940

(22) Filed: Jun. 7, 2019

(65) Prior Publication Data

US 2020/0385926 A1 Dec. 10, 2020

(51) Int. Cl.
*D21D 1/30* (2006.01)

(52) U.S. Cl.
CPC ..... *D21D 1/303* (2013.01); *D21D 1/30* (2013.01); *D21D 1/306* (2013.01)

(58) Field of Classification Search
CPC ..... D21D 1/303; D21D 1/30; D21D 1/306
See application file for complete search history.

(56) References Cited

U.S. PATENT DOCUMENTS

| | | | | |
|---|---|---|---|---|
| 3,507,049 | A | 4/1970 | Heldt | |
| 3,984,057 | A * | 10/1976 | Pilao | D21D 1/22 241/248 |
| 4,185,391 | A | 1/1980 | Roley | |
| 4,776,826 | A | 10/1988 | Scott | |
| 5,348,515 | A | 9/1994 | Miller | |
| 6,390,244 | B1 * | 5/2002 | Sitter | F16D 66/00 188/1.11 W |
| 6,415,735 | B1 | 7/2002 | Rogers | |
| 7,018,313 | B2 | 3/2006 | Nakamura | |
| 7,188,792 | B2 | 3/2007 | Chase, Jr. | |
| 2011/0138951 | A1 | 6/2011 | Mashue et al. | |

* cited by examiner

*Primary Examiner* — Faye Francis
(74) *Attorney, Agent, or Firm* — James Earl Lowe, Jr.

(57) ABSTRACT

A hub and a member, the member having a central opening. The hub is received in the member central opening. The hub has a center, and a hub axis through the center. The hub also has a splined exterior with a plurality of splines, each spline having a spline surface, and the member central opening has internal splines that engage with the hub splined exterior. At least one of the hub splines has a wear indicator, the wear indicator comprising a surface mark that extends along a portion of the spline surface in the same direction as the hub axis.

2 Claims, 9 Drawing Sheets

REFINING MEMBER AND HUB WITH SPLINES WITH A WEAR INDICATOR

BACKGROUND

The present disclosure relates to refiners for wood pulp or the like, and more particularly to improvements in refiners wherein stationary refining plates flank rotary refining plates in the chamber of a housing whose inlet admits stock for treatment by comminuting projections (e.g., ribs) on the neighboring surfaces of stationary refining plates and rotary refining plates.

It is already known to utilize in a disc or rotor refiner two coaxial or eccentric plates or discs each of which is driven by a discrete prime mover and which have neighboring surfaces provided with ribs or otherwise configured projections which comminute the material to be treated while the material advances from the inlet toward the outlet of the stock chamber.

It is further known to use a pair of discs one of which is stationary and the other of which rotates relative to the stationary disc.

It is also known to dispose two rotary discs between two stationary discs so that each rotary disc cooperates with a different stationary disc. The rotary discs are mounted at the opposite sides of a disc-shaped carrier which is driven by a shaft. The stock is fed through one of the stationary discs to enter the space between the one stationary disc and the respective rotary disc, and some of the stock is allowed to pass through relatively small openings in the rotary discs to enter the space between the other rotary disc and the other stationary disc.

It is also known, as shown in U.S. Pat. No. 7,188,792, issued Mar. 13, 2007, to provide a hub and a refining member adapted to be used in a refiner for pulp or like materials, the refining member having a central opening, the hub having a center, and a hub axis through the center, the hub being received in the refining member central opening. The hub and refining member have means for transmitting torque from the hub to the refining member, the torque transmitting means comprising the hub having a splined exterior with a plurality of splines, each spline having a spline surface, and the refining member central opening having internal splines that engage with the hub splined exterior.

The driving face of each hub spline wears with use. An example of a portion of a hub spline that can wear away is shown as 203 in FIG. 11. As a result, a hub needs to be reversed (flipped) after the driving face wears so that the other face of the spline now becomes the driving face. After a period of time the new driving face wears as well. After this happens, a new hub with new splines is required.

It is difficult to accurately measure the spline wear of the refiner splines to know when to flip or replace the hub. Users struggle to obtain accurate wear measurements, so anything that can be done to make this process easier would be better. In numerous cases, users have run beyond the allowable wear for the first spline life cycle and they sacrifice the second spline life cycle. Providing a tool that will help users maximize the life of their investment is good for all.

It is difficult to accurately measure the spline wear of the refiner splines to know when to flip or replace the hub.

SUMMARY

Disclosed is a hub and a member, the member having a central opening. The hub is received in the member central opening. The hub has a center, and a hub axis through the center. The hub also has a splined exterior with a plurality of splines, each spline having a spline surface, and the member central opening has internal splines that engage with the hub splined exterior. At least one of the hub splines has a wear indicator, the wear indicator comprising a surface mark that extends along a portion of the spline surface in the same direction as the hub axis.

The surface mark is at the edge of the spline at the maximum allowable wear point. This provides a visual as to the health of the splines and allows a user to quickly and accurately know when the hub lifespan has ended.

The spline can be marked by machine grinding, waterjet, or laser engraving wear lines at the end and along the length of the spline so that once the wear has reached the line, it is time for flipping or replacing the hub. This makes spot checking quick and easy and leaves nothing to interpretation.

Figure 1:
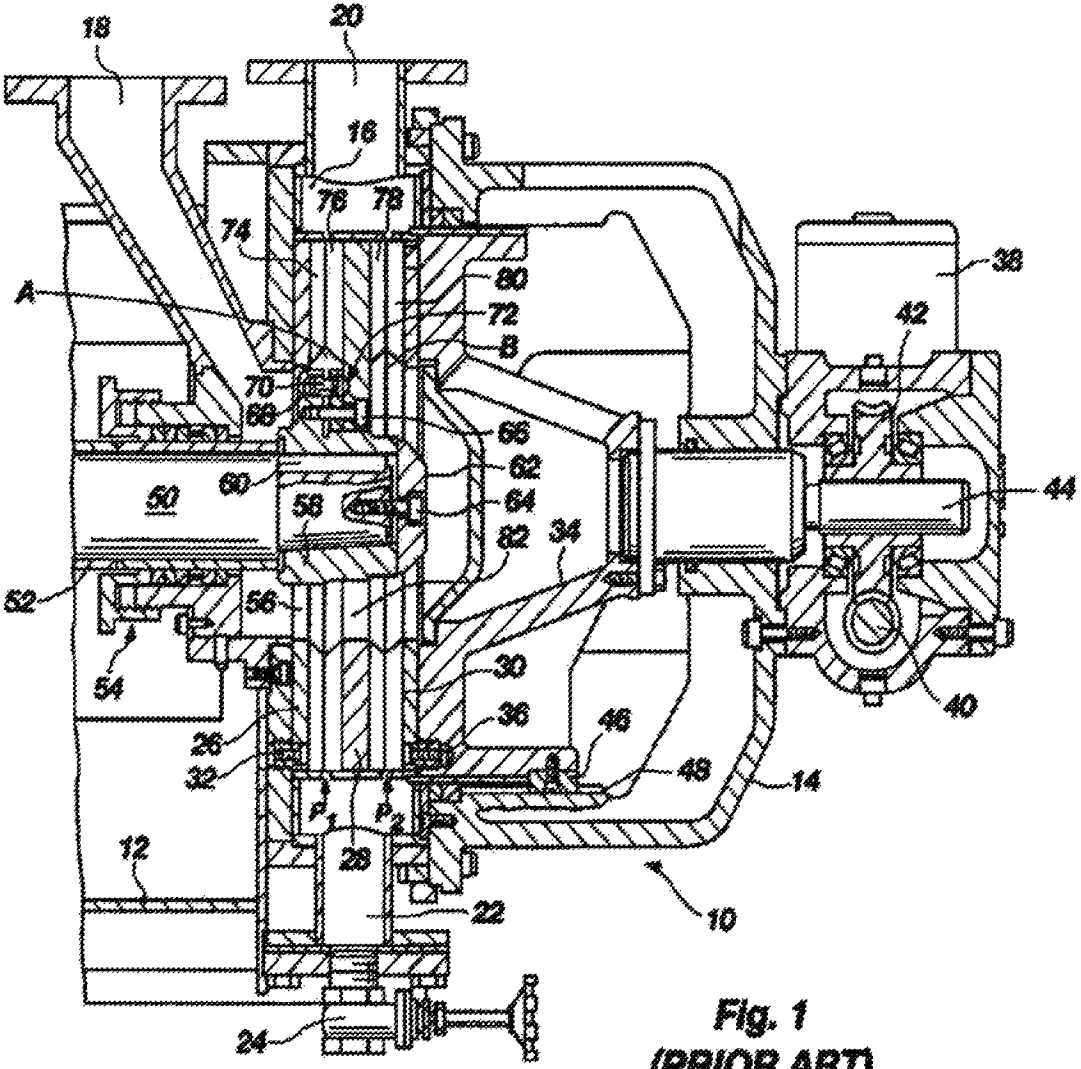
Fig. 1 (PRIOR ART)
FIG. 1 is a fragmentary longitudinal vertical sectional view of a prior art refiner.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE EMBODIMENTS

Elements in Common with the Prior Art

Referring first to FIG. 1, there is shown a prior art disc refiner having a housing 10 including several bolted-together sections two of which are shown at 12 and 14. The description of FIGS. 1 through 5 comes from one such prior art construction, as shown in Pilas U.S. Pat. No. 3,984,057. The housing defines a stock chamber 16 and has an inlet 18 for admission of pulp, e.g., from the outlet of a pump, a first outlet 20 for evacuation of refined pulp, at least in part under the action of centrifugal force, and a second outlet 22 which is normally closed by a suitable valve 24. The outlet 20 extends upwardly and the outlet 22 extends downwardly; the valve 24 is opened when the attendants wish to drain the liquid carrier for wood chips or the like from the chamber 16.

The chamber 16 accommodates three refining members 26, 28, 30 here shown as coaxial discs having identical outer diameters. In other embodiments (not shown), two back to back discs can be used instead of the single disc 28. In still other embodiments (not shown), additional disc sets can be used. In still other embodiments (not shown), the refining members may constitute cones or other types of refining members.

The disc 26 is stationary and is fixedly secured to the housing section 12 by screws 32 or analogous fasteners. The disc 30 does not rotate. This disc is spaced apart from the disc 26 and is secured to an axially movable support 34 by means of screws 36 or the like. The support 34 is mounted in the housing section 14 and is movable axially of the discs 26, 28 by a reversible electric motor 38 which can drive a worm 40. The latter meshes with a worm wheel 42 having internal threads in mesh with external threads at the right-hand end of a spindle 44 which is rigid with the support 34, The support 34 has one or more radial projections or followers 46 slidable in elongated grooves 48 of the housing section 14. The grooves 48 are parallel to the common axis of the discs 26, 28 and 30. In other embodiments, other mechanisms for supporting the disc 30 can be used.

The disc 28 is rotatable relative to and is movable axially between the discs 26 and 30. The means for rotating the disc 28 comprises a drive shaft 50 which rotates in a sleeve 52 mounted in the housing section 12. The sleeve 52 is surrounded by a stuffing box 54 which prevents the escape of pulp from the chamber 16 into the left-hand portion of the housing section 12. That end portion of the shaft 50 which extends from the housing section 12 preferably carries a pulley or sprocket wheel driven by an electric motor or another suitable prime mover through the medium of an endless belt or chain. Other types of transmissions between the prime mover and the shaft 50 can be used with equal advantage.

The disc 26 has a relatively large central opening 56 which communicates with the inlet 18 and surrounds the shaft 50 with a substantial amount of clearance. That end portion of the shaft 50 which extends beyond the opening 56 and into the central part of the chamber 16 carries a hub 58 which is secured thereto by a key 60, a cap 62 and a screw 64 so that the hub 58 shares all angular movements of the shaft 50. The hub 58 transmits torque to the centrally located disc 28 by way of several screws 66 but the disc 28 has limited freedom of axial movement relative to the hubs 58 and screws 66. The hub is provided with an eccentric blind bore 68 for a guide pin 70 a portion of which extends into an aligned blind bore 72 of the disc 28. It can be said that the disc 28 "floats" between the discs 26, 30 and automatically finds a central position between the stationary discs 26, 30, not only in response to wear on the surfaces of comminuting projections on the discs but also upon axial adjustment of the disc 30.

Figure 2:
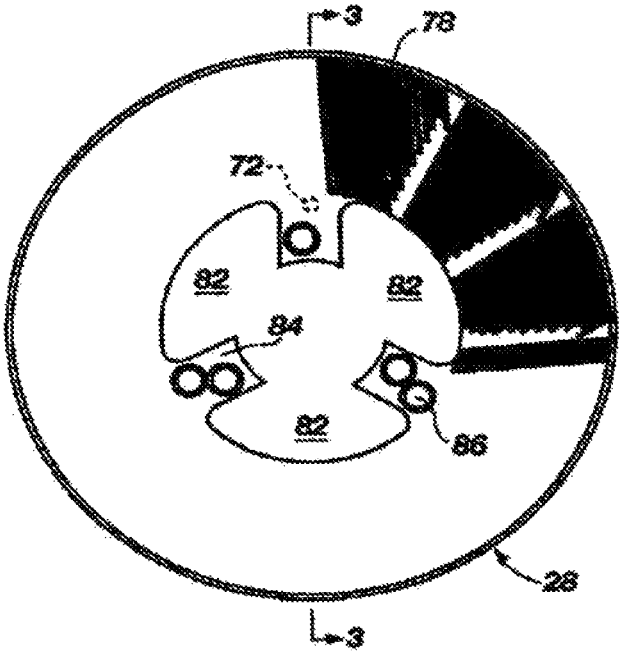
Fig. 2 (PRIOR ART)
FIG. 2 is a side elevational view of a rotary refining member in the refiner of FIG. 1.
Figure 3:
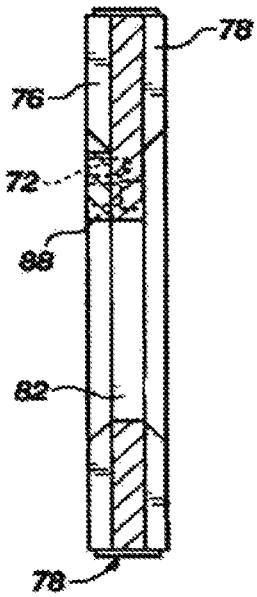
Fig. 3 (PRIOR ART)
FIG. 3 is an axial sectional view as seen in the direction of arrows from the line 3-3 of FIG. 2.

The discs 26, 28 and 28, 30 respectively define first and second paths A and B along which the pulp can advance from the inlet 18 toward the first outlet 20 (the second outlet 22 is assumed to be sealed when the refiner is in use), The path A is flanked by rib-shaped comminuting projections 74, 76 of the discs 26, 28, and the path B is flanked by rib-shaped comminuting projections 78, 80 of the discs 28, 30. The opening 56 of the disc 26 admits pulp from the inlet 18 into the central portion of the first path A, and such pulp flows radially outwardly between the projections 74, 76 toward the outlet 20. The central portion of the disc 28, as shown in FIG. 2, has three kidney-shaped openings 82 whose combined cross-sectional area is less than the effective area of the opening 56. The openings 82 connect the path A with the path B so that some of the pulp which is admitted via opening 56 flows through the openings 82 and into the path B to be comminuted by the projections 78, 80 on its way toward the outlet 20. The openings 82 are partially separated from each other by radially inwardly extending portions 84 one of which has the blind bore 72 and each of which has one or more untapped bores 86 for the respective screws 66.

Figure 4:
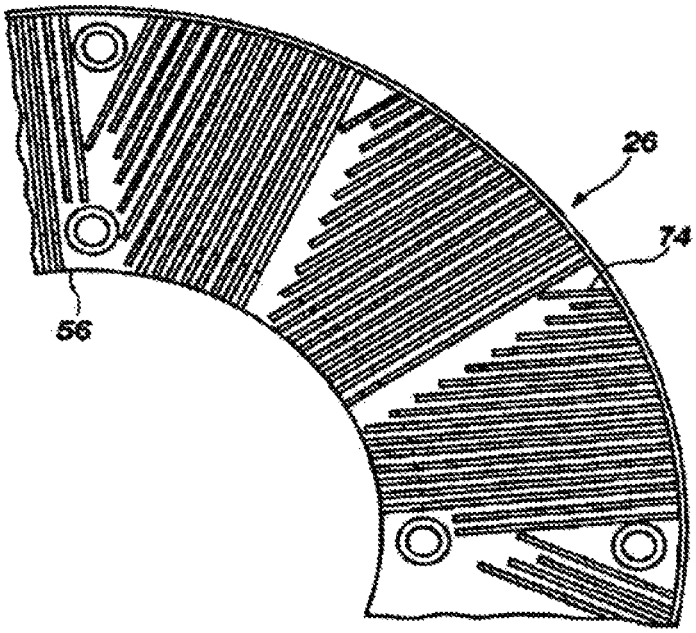
Fig. 4 (PRIOR ART)
FIG. 4 is a fragmentary elevational view of a first refining member in the refiner of FIG. 1.

FIG. 4 shows a portion of the disc 26 which may be identical with the disc 30. The diameter of the opening 56 in the disc 26 is one-half the outer diameter of this disc. The effective area of the opening 56 is that area of this opening which surrounds the corresponding portion of the shaft 50. The combined effective area of the openings 82 in the disc 28 is smaller than the effective area of the opening 56 because the disc 28 receives the hub 58 and also because this disc is formed with the portions 84. However, the combined effective area of the openings 82 is large enough to ensure that the quantity of pulp which flows from the openings 82 into the path B is identical or practically identical with the quantity of pulp flowing from the opening 56 into the path A.

Figure 5:
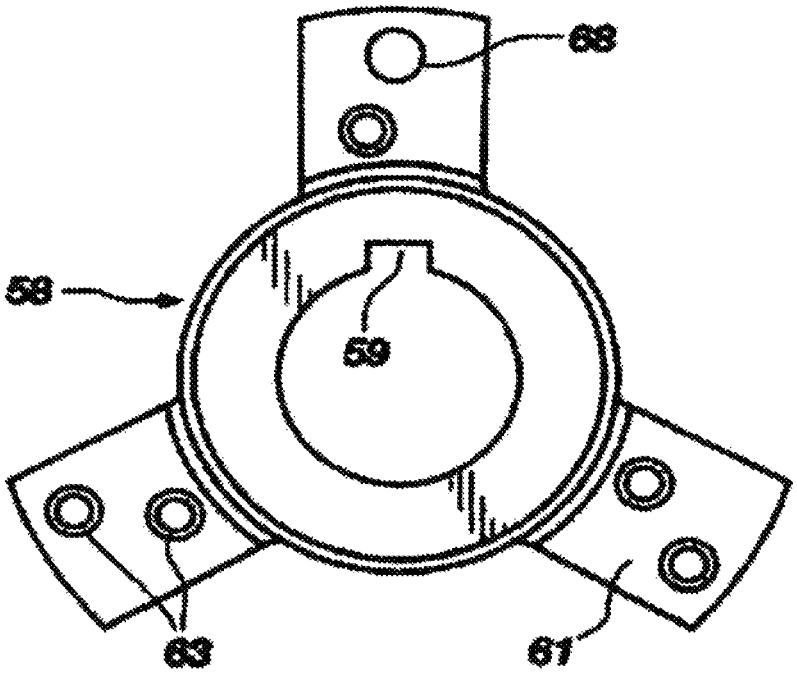
Fig. 5 (PRIOR ART)
FIG. 5 is an elevational view of a hub which forms part of the means for rotating the third refining member in the refiner of FIG. 1.

FIG. 5 shows the prior art hub 58. This hub has a keyway 59 for the key 60 and three radially outwardly extending arms 61 which overlie and are secured to the portions 84 of the disc 28. One of the arms 61 has the bore 68 for a portion of the guide pin 70 and each arm has at least one tapped bore 63 for the stem of the respective screw 66.

In another embodiment (not shown), the outside diameter of the prior art hub is splined and is of a diameter that is calculated to be of adequate strength while staying inside the cross-head porting required to supply stock to the second path B. The hub is held in place on the shaft with the cap 62 and screw 64, centered on the end of the shaft 50. The cap 62 may be of a diameter to also retain the disc 28 from coming off the end of the splined hub.

Figure 6:
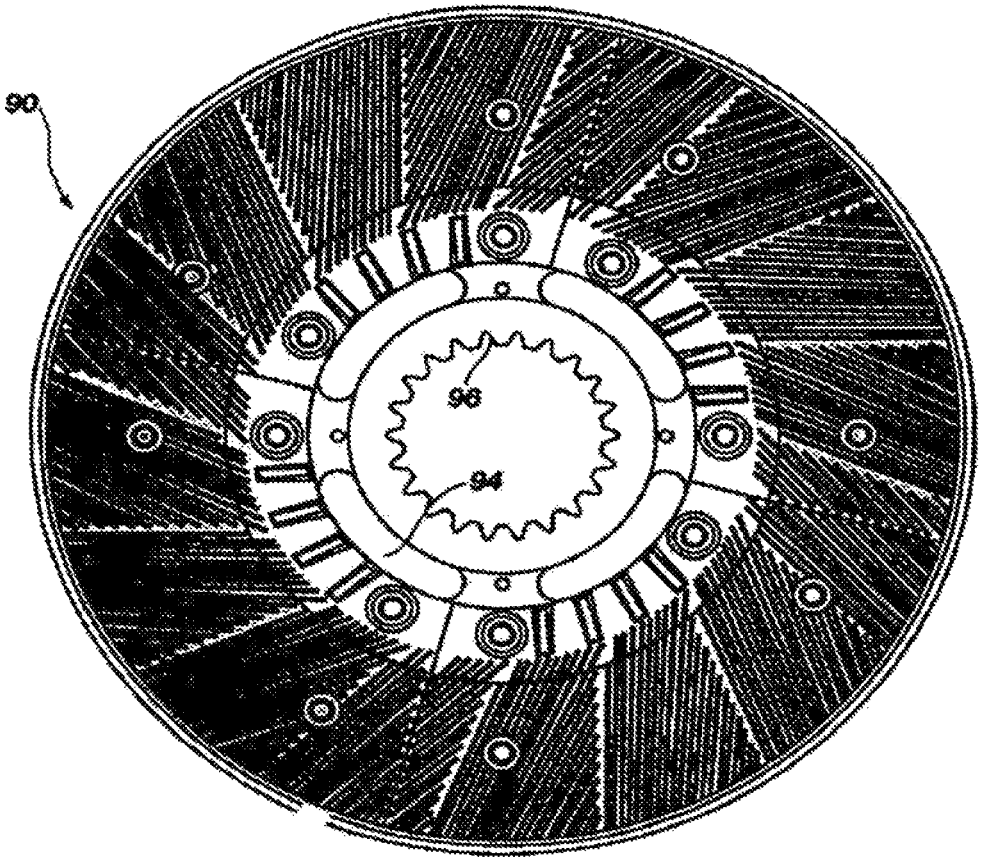
Fig. 6 (PRIOR ART)
FIG. 6 is a side elevational view of another embodiment of the prior art refining member shown in FIG. 2.

As shown in FIG. 6, another prior art rotating disc 90 is a large, round flat plate, usually with retaining lips on the outside diameter of both sides of the disc 90, to aid in positioning and retaining the discs 26 and 30. The disc 90 is designed to be positioned between the two stationary discs 26 and 30 and to be driven by the splined hub described above. The disc 90 has cross flow porting 94 located between the spline 96 that engages the hub spline and the inner diameter of the disc 90.

The cross-flow porting port holes 94 are usually limited in size due to the requirements for hoop stress for the spline 96 and torsional loading through the area between the ports 94.

The Hub of this Disclosure

Figure 7:
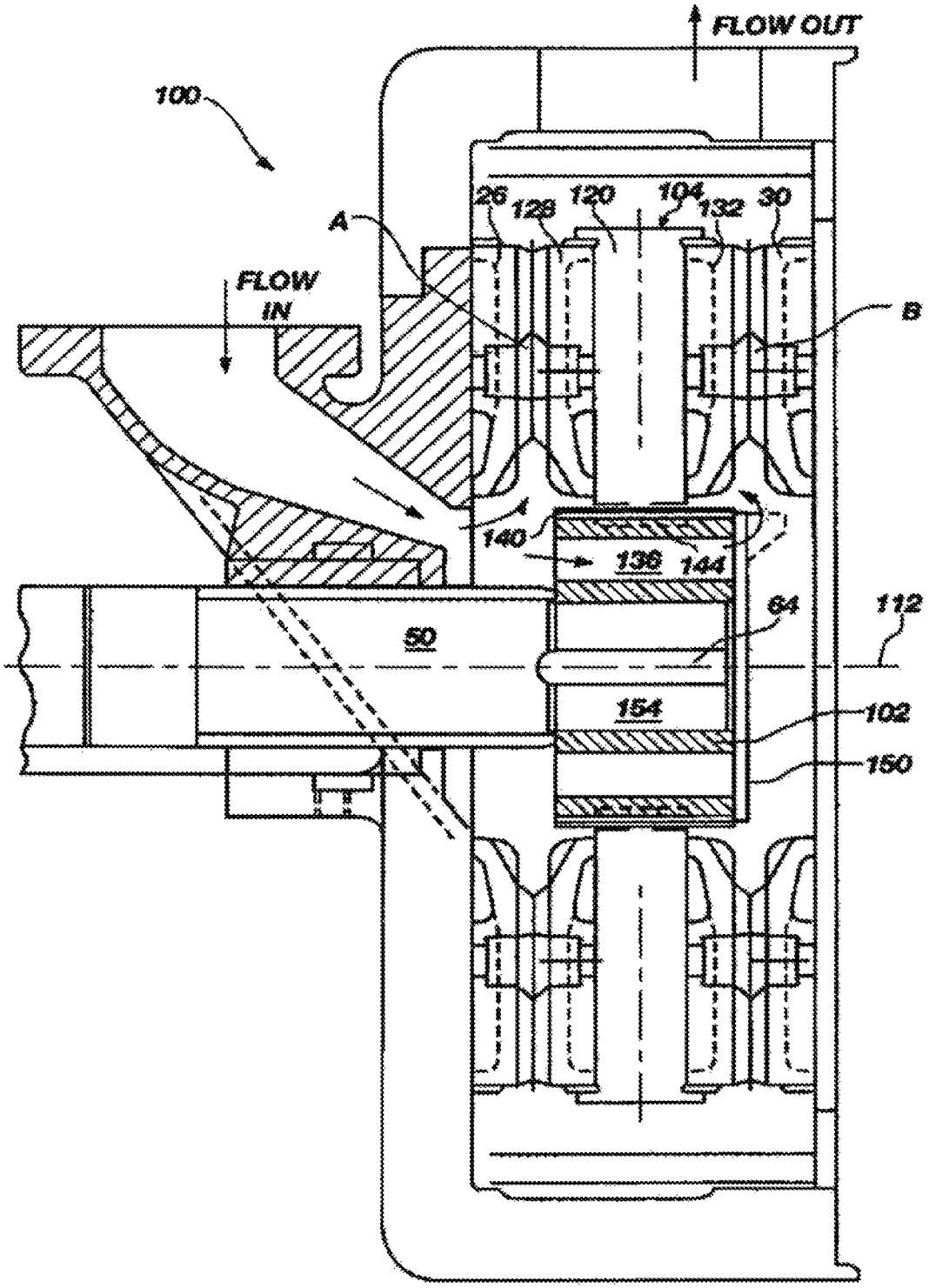
FIG. 7 is a fragmentary partly longitudinal vertical sectional view of a refiner with a hub with spline wear indicators and a disc forming a rotary refining member in accordance with this disclosure.

FIG. 7 shows a refiner 100 with a hub 102 and disc 104 forming a rotary refining member in accordance with this disclosure. More particularly, the refiner, except for the hub 102, disc 104 and cap 150, is essentially the same as that shown in FIG. 1.

Figure 8:
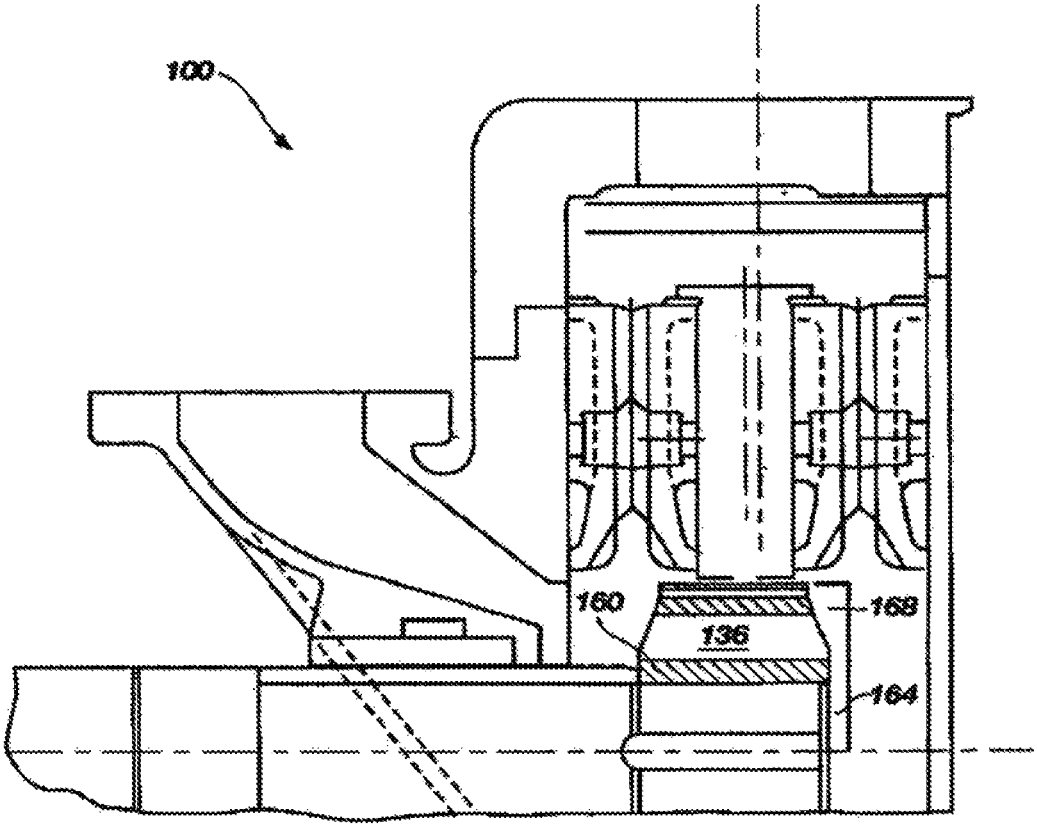
FIG. 8 is a fragmentary partly longitudinal vertical sectional view similar to FIG. 7, only showing an alternate hub and end plate construction.
Figure 9:
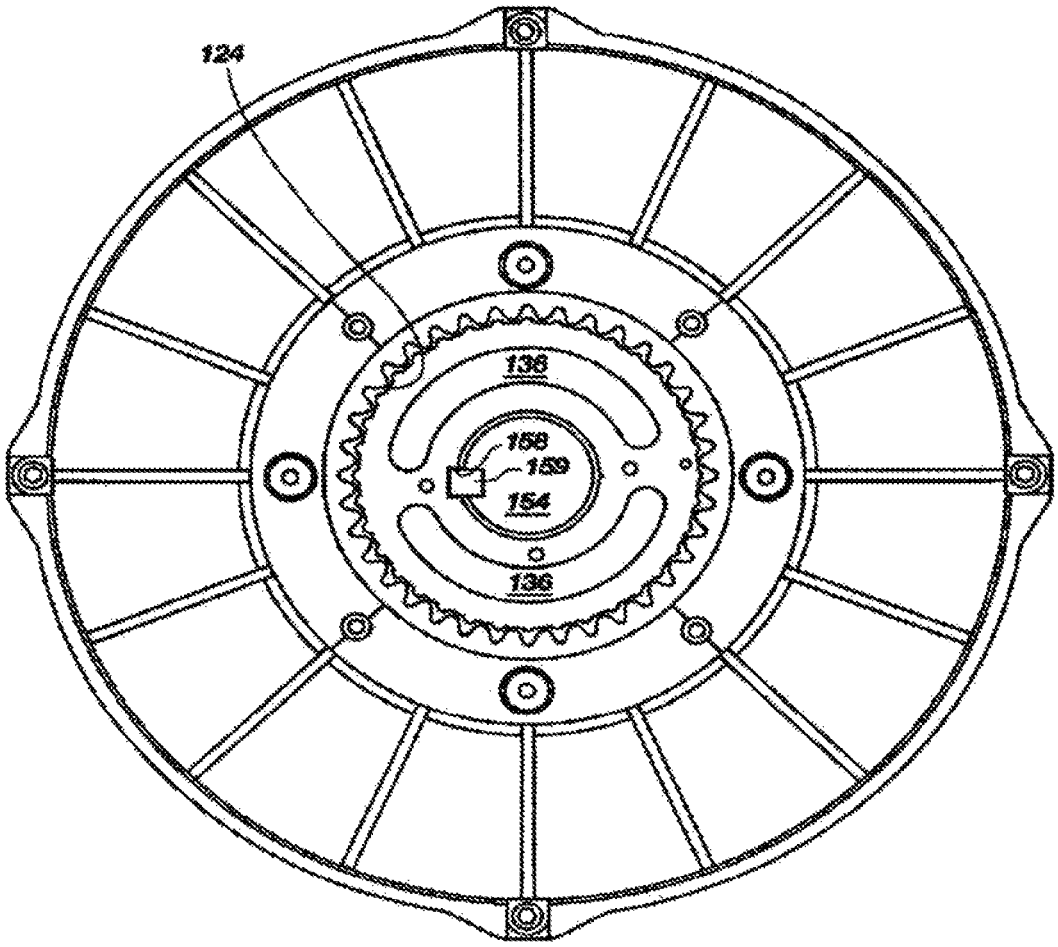
FIG. 9 is a side elevational view of the hub and rotary refining member shown in FIGS. 7 and 8.
Figure 10:
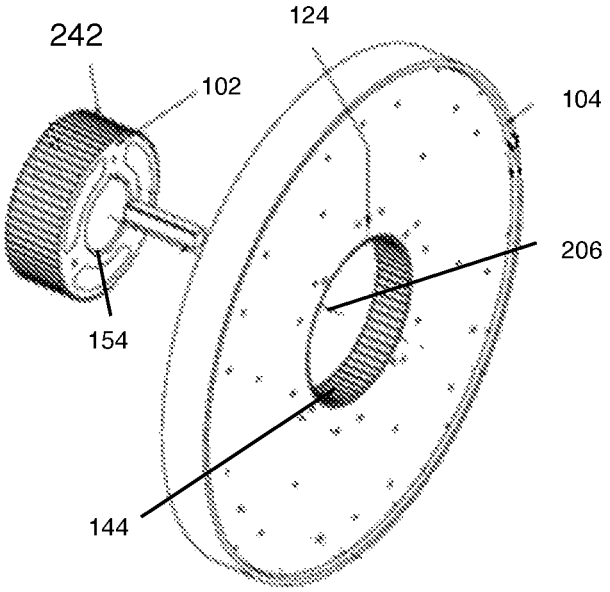
FIG. 10 is an exploded side perspective view of the hub and rotary refining member of FIG. 9.

More particularly, as shown in FIGS. 7, 8 and 9, the hub 102 is rigid with the drive shaft 50 and has an exterior with splines 242 (see FIG. 10). Still more particularly, as shown in FIG. 9, the hub 102 has a conventional standard round bore or center 154 with a keyway 158 for an industry standard keyway 159. The outside of the hub 102 is larger than conventional splined hubs, and the hub 102 is only slightly smaller than the inside diameter of a standard refiner plate for any given size. This larger spline diameter produces many more splines than standard splined hubs that must stay inside the portholes 94 (as shown in FIG. 6) for through flow rotating heads. The hub 102 greater spline pitch diameter with the increased number of splines reduces the spline contact forces thus reducing stress in the splines and reducing wear, thus increasing refiner service life.

The hub 102 is received in the third refining disc central opening 124, and the hub 102 has at least one port 136 in the hub 102 from the first path A to the second path B and between the third refining disc central opening 124 and the center 154 of the hub 102. In the preferred embodiment, the hub 102 has two ports 136, as shown in FIG. 9. The refiner 100 further includes means for transmitting torque from the hub 102 to the third disc 104, the torque transmitting means comprising the splines 242 on the hub outer surface, and the third refining disc central opening 124 having splines 144 that engage the hub splines 242. The hub splines 242 and third disc splines 144 permit the third disc 104 to move axially along the hub 102.

In a preferred embodiment, the third refining or rotary disc 104 comprises a central disc-shaped carrier or support 120 having a central opening 124, and a first plate 128 secured by screws on one side of the central support 120 and a second plate 132 secured by screws on the opposite side of the central support 120. Since the cross-flow ports are now located within the hub 102, the third disc 104 does not have cross flow ports. In less preferred embodiments (not shown), however, some cross-flow ports could be provided in the third disc 104.

In a preferred embodiment, as shown in FIGS. 7 and 8, the hub is held on an end of the drive shaft 50 by a mixing blade 150 instead of a cap. The simplest design of the mixing blade 150 is a flat bar of some thickness. The flat bar only partially covers the ports. This acts as a flat blade propeller driving the stock away from the disc eye into the outer set of refiner plates. This mixing blade may be modified with two or more added blades (as shown in ghost in FIG. 7); either flats or swept to further enhance flow distribution from the cross-flow ports. They will also enhance the flow through the hub by creating a larger differential pressure across the hub. In other embodiments, the blades can be omitted.

FIG. 8 is a fragmentary partly longitudinal vertical sectional view similar to FIG. 7, only showing an alternate hub 160 and mixing blade 164 construction. In this construction, the outside diameter of the hub 160 is narrower in the axial direction than the central portion of the hub 102 in order to further improve flow of stock into the flow paths between the discs. And in this embodiment, the mixing blade 104 has added extensions 168 facing the hub 160.

The location of the cross-flow portholes 136 into the hub are designed to be fewer in number to reduce flow friction losses. Cross flow areas are equal to or exceed conventional porting, and the mixing blade 150 is now positioned to influence the flow.

Figure 11:
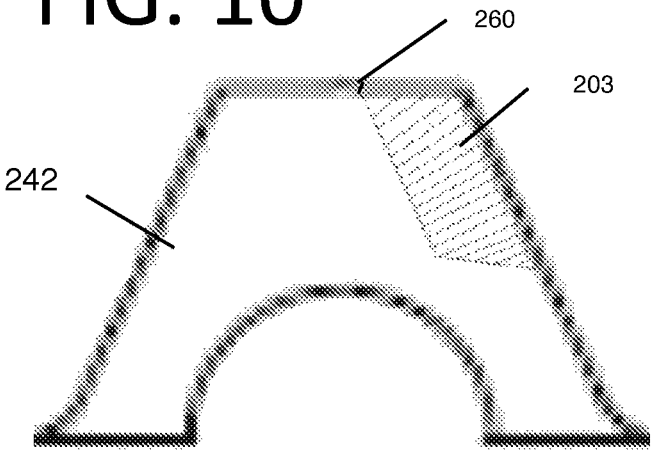
FIG. 11 is a schematic cross section view of one of the splines on the hub of FIG. 10, with a shaded area representing an area where a spline will typically wear with use.
Figure 12:
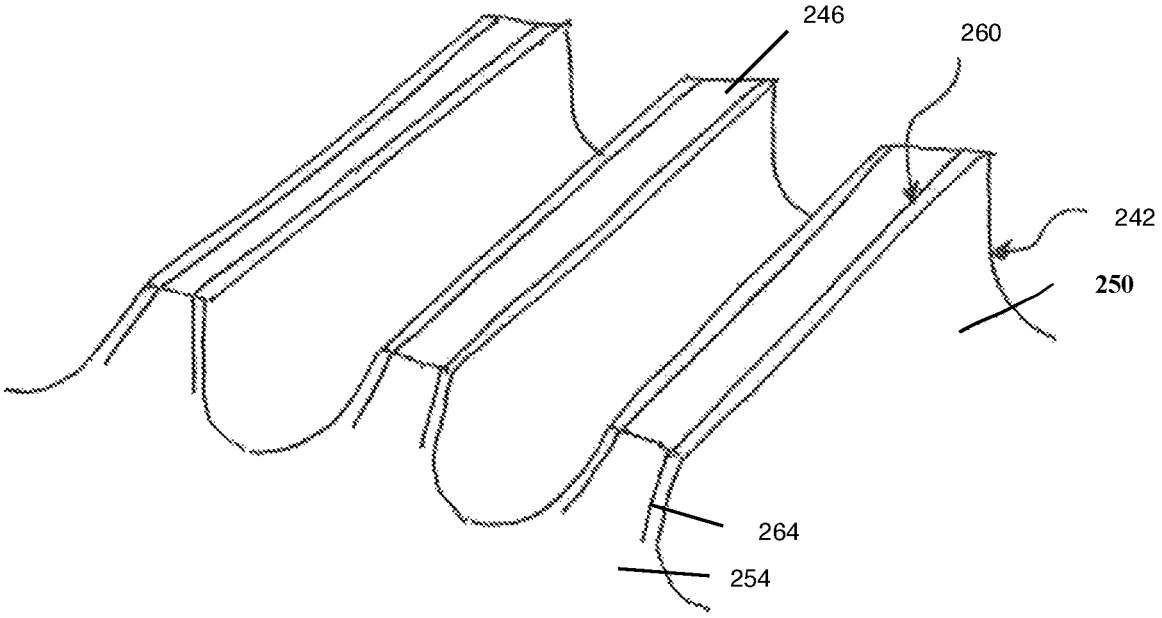
FIG. 12 is a side perspective view of the splines on the hub of FIG. 10, with longitudinal wear indicator lines added to the tops of at least some of the splines and wear indicator lines at the end faces of the splines.

The hub 102 has a hub axis 206 through the center 154. The hub splines 242 each have a spline top surface 246, a spline side surface 250, and a spline end surface or face 254. The refining member central opening 124 also has internal splines 144 that engage the hub splines 242. Further, at least one of the hub splines 242 has a wear indicator 260 (see FIG. 11), the wear indicator 260 being in the form of a longitudinally extending surface mark that extends along the spline top surface 246 in the same direction as the hub axis 206. In one embodiment, the wear indicator lines 260 are on the top surfaces 246 of each of the splines 242. More particularly, there are the longitudinal wear indicator lines 260 added to the top surfaces of the splines and additional wear indicator lines 264 at the end faces 254 of the splines 242. The wear indicator lines 260 and 264 are markings made by either machine grinding, water jetting, or laser engraving or etching at the end and along the length of each spline 242. In a preferred embodiment, the wear indicator line 260 is at the location on the spline at the maximum allowable wear point.

Once wear has reached one of the indicator lines 260 or 264, it is time for flipping or replacing the hub 102. This makes spot checking quick and easy and leaves nothing to interpretation. It Is therefore no longer difficult to accurately measure the spline wear of the refiner splines 242 to know when to replace the hub 102. Users will no longer struggle to obtain accurate wear measurements.

Various other features and advantages of the disclosure will be apparent from the following claims.

The invention claimed is:

1. A combination including a hub and a refining member, the refining member having a central opening, the hub having a center, and a hub axis through the center, the hub being received in the refining member central opening for transmitting torque from the hub to the refining member, the hub having a splined exterior with a plurality of splines, each spline having a spline top surface, a spline side surface, and a spline end surface, and the refining member central opening having internal splines that engage with the hub splined exterior, with at least one of the hub splines having a wear indicator, the wear indicator comprising a surface mark that extends along a portion of the spline top surface in the same direction as the hub axis.

2. The combination of a hub and refining member according to claim 1 wherein the wear indicator is also on the spline end surface.

* * * * *